US009308977B2

(12) United States Patent
Andersen

(10) Patent No.: US 9,308,977 B2
(45) Date of Patent: Apr. 12, 2016

(54) SURFACE-CLEANING DEVICE AND VEHICLE

(71) Applicant: GAC EnvironHull Limited, Dubai (AE)

(72) Inventor: Robert Andersen, Notodden (NO)

(73) Assignee: GAC Environhull Limited, Dubai (AE)

( * ) Notice: Subject to any disclaimer, the term of this patent is extended or adjusted under 35 U.S.C. 154(b) by 166 days.

(21) Appl. No.: 13/904,864

(22) Filed: May 29, 2013

(65) Prior Publication Data

US 2013/0263770 A1 Oct. 10, 2013

Related U.S. Application Data

(63) Continuation of application No. PCT/NO2011/000333, filed on Nov. 24, 2011.

(30) Foreign Application Priority Data

Nov. 29, 2010 (NO) ..... 20101673

(51) Int. Cl.
*B63G 8/14* (2006.01)
*B63B 59/08* (2006.01)
(Continued)

(52) U.S. Cl.
CPC ..... *B63B 59/08* (2013.01); *B63G 8/001* (2013.01); *B63G 8/26* (2013.01)

(58) Field of Classification Search
CPC ..... B63B 59/08; B63B 59/10; B63B 59/06; B63B 59/04; B63B 2059/025; B63B 2059/085; B63B 2059/087
USPC ..... 114/221 R, 222, 230
See application file for complete search history.

(56) References Cited

U.S. PATENT DOCUMENTS 3,362,367 A 1/1968 Rosfelder
3,598,074 A 8/1971 Schubert
(Continued)

FOREIGN PATENT DOCUMENTS

AU 627484 B2 8/1992
DE 2316761 A1 10/1974
(Continued)

OTHER PUBLICATIONS

International Search Report for International Application No. PCT/NO2011/000333 dated Oct. 17, 2012 (8 pages).
(Continued)

*Primary Examiner* — Anthony Wiest
(74) *Attorney, Agent, or Firm* — Osha Liang LLP

(57) ABSTRACT

A remotely operated underwater vehicle for cleaning surfaces submerged in water, the underwater vehicle having a first side, a second side, a propulsion means, a plurality of trimming means, a first buoyancy means attached to the first side and a second buoyancy means attached to the second side. Elements of the plurality of trimming means are arranged on opposite sides of the centre of gravity of the vehicle and at least one of the plurality of trimming means has a movable mass and a displacement region into which the movable mass can move. The center of gravity of the vehicle is automatically shifted when the vehicle is accelerating or changes orientation, in which the first buoyancy means provides more buoyancy than the second buoyancy means such that the center of buoyancy is located above the center of gravity of the vehicle irrespective of the orientation of the vehicle.

16 Claims, 10 Drawing Sheets

(51) Int. Cl.
*B63G 8/00* (2006.01)
*B63G 8/26* (2006.01)

(56) References Cited

U.S. PATENT DOCUMENTS

| | | | | | |
|---|---|---|---|---|---|
| 4,015,553 | A | | 4/1977 | Middleton | |
| 4,462,328 | A | | 7/1984 | Oram | |
| 4,926,775 | A | | 5/1990 | Andorsen | |
| 5,222,452 | A | | 6/1993 | Maloney et al. | |
| 5,381,751 | A | | 1/1995 | Richards et al. | |
| 5,431,122 | A | * | 7/1995 | Templet, Jr. | 114/222 |
| 5,577,293 | A | | 11/1996 | Meredith et al. | |
| 5,947,051 | A | * | 9/1999 | Geiger | 114/313 |
| 6,315,648 | B1 | | 11/2001 | Neer | |
| 6,604,696 | B1 | | 8/2003 | McGuire | |
| 2011/0094433 | A1 | | 4/2011 | Shoda et al. | |

FOREIGN PATENT DOCUMENTS

| | | | |
|---|---|---|---|
| DE | 102004062126 | A1 | 7/2006 |
| DE | 102008024815 | B3 | 7/2009 |
| EP | 0850830 | A2 | 7/1998 |
| EP | 1216761 | A1 | 6/2002 |
| EP | 2251102 | A1 | 11/2010 |
| GB | 2194136 | A | 3/1988 |
| KR | 1020080093536 | A | 10/2008 |
| NO | 169000 | B | 1/1992 |
| WO | 9858837 | A1 | 12/1998 |
| WO | 9907489 | A1 | 2/1999 |
| WO | 2005/044657 | A1 | 5/2005 |
| WO | 2007045887 | A2 | 4/2007 |
| WO | 2009142506 | A1 | 11/2009 |
| WO | 2009154006 | A1 | 12/2009 |

OTHER PUBLICATIONS

Written Opinion for International Application No. PCT/NO2011/000333 dated Oct. 17, 2013 (6 pages).

Norwegian Search Report for Patent Application No. 20101673 dated May 12, 2011 (1 page).

Espacenet Publication Abstract for WO2009154006, publication date Dec. 23, 2009 (2 pages).

* cited by examiner

SURFACE-CLEANING DEVICE AND VEHICLE

FIELD OF THE INVENTION

The invention concerns surface-cleaning devices. More specifically, the invention concerns the cleaning of large submerged surfaces which offer limited availability for conventional cleaning methods, such as a partly submerged hull of a ship. The invention also concerns a remotely operated underwater vehicle for carrying the cleaning devices.

BACKGROUND OF THE INVENTION

A ship's hull which is subjected to marine organisms is prone to barnacle growth and general fouling, making the hull surface rough and uneven. This leads to greater friction resistance when the ship is propelled through the water, which in turn means a significant increase in fuel consumption. It is known that a 1% increase in friction causes approximately a 3% fuel consumption increase. Frequent hull cleaning is therefore required, both from economical and environmental points of view.

Developing suitable and practical cleaning equipment for large surfaces, such as ships' hulls, is a considerable challenge, partly due to the hulls' limited accessibility when submerged in water.

Also, ships' hulls are commonly coated with toxic paints, containing organic tin compounds. Such compounds should not be dislodged from the hull, as they may contaminate the surrounding marine life. It is therefore desirable to use cleaning equipment that removes impurities (fouling, etc.) from the hull but damages the hull paint as little as possible.

The state of the art includes a number of devices for cleaning large surfaces, such as ships' hulls, comprising both the use of brushes and spraying with pressurized water through nozzles. Some devices have nozzles arranged on rotatable members, some have the nozzles arranged on an arm or on a ring-shaped member, while others have the nozzles arranged on a solid disc.

U.S. Pat. No. 4,926,775 discloses a cleaning device intended for use on mainly vertical surfaces under water. The apparatus comprises nozzles, arranged on a rotary disc, to spray water under high pressure against a surface. The rotational axis of the disc is mainly perpendicular to the surface to be cleaned. The nozzles are arranged obliquely, in order to provide the spraying water with a tangential motion component, leading to a reactive force that sets the disc in rotation. In addition one or more of the nozzles are directed away from the surface to be cleaned in order to maintain the apparatus in a position close to the same surface.

WO 2005/044657 discloses a device for cleaning underwater surfaces, such as ships' hulls. The device comprises a rotary disc having nozzles for discharging pressurized liquid against the surface to be cleaned. The nozzles are mounted obliquely in relation to the rotational axis of the rotary disc and are arranged to be supplied with pressurized liquid through a hollow spindle that is concentric with the rotational axis.

The state of the art also includes remotely operated vehicles (commonly referred to as an ROV) for carrying hull cleaning devices. One example is disclosed by KR 2008/0093536 A, describing an underwater robot for cleaning and inspecting a ship hull. The robot comprises wheels for rolling on the submerged hull, vertical/horizontal thrusters to induce movement in the vertical and horizontal directions, and a water jet spraying device. The robot wheels are driven by motor, whereby the robot is driven along the ship hull. The robot is remotely controlled from a console (above water), via an umbilical cable.

Another example of an ROV-carried hull cleaning device is disclosed by U.S. Pat. No. 4,462,328, describing a carriage with wheels for travelling along the ship hull and having a plurality of cleaning nozzles and a reactor nozzle aligned to produce a reactive force which opposed the force component of the cleaning nozzles which tends to urge the carriage away from the hull of a ship.

It is an object of this invention to provide cleaning device and vehicle which is more efficient and simpler to operate that those of the prior art.

SUMMARY OF THE INVENTION

The invention is set forth and characterized in the main claims, while the dependent claims describe other characteristics of the invention.

It is also provided a device for cleaning of surfaces submerged in water, comprising a disk member rotatably supported by a spindle and configured for rotation about a rotational axis by drive means; said disk member having a first side which is facing said surface when the device is in use, and a second side facing away from the surface, and where the disk member further comprises a plurality of nozzles for discharging liquid under pressure against the surface to be cleaned; said nozzles being fluidly connected to a liquid reservoir via a first conduit in the disk member and a second conduit in the spindle, characterized in that the disk member comprises a plurality of through holes, spaced at regular intervals and arranged symmetrically with respect to the rotational axis.

In one embodiment, a plurality of ridges is arranged at regular intervals on the first side and extending radially. Preferably, successive ridges alternating extend to a respective one of said through holes and between adjacent through holes. The height of each ridge is in one embodiment decreasing radially, from a maximum height near the disk central portion, to a minimum height in a disk peripheral portion.

In one embodiment, the first side comprises a concave portion, symmetrically with the rotational axis. The through holes are preferably circular and have in one embodiment bores that are substantially parallel with the disk rotational axis. In another embodiment, the bores are slant with respect to the disk rotational axis. In a further embodiment, each through hole further comprises a vane rotatably supported in the hole and arranged radially in the disk member.

The nozzles are arranged at regular intervals around the disk member periphery and arranged for discharging liquid in a radial direction and towards the surface to be cleaned.

The second conduit in the spindle is preferably concentric with the rotational axis, and the disk member is rotatably supported in a housing, thus defining a cavity between the second side and the housing interior. The housing comprises at least one liquid discharge opening.

In a preferred embodiment, the drive means is configured for rotating the disk member at a speed in the range 200 rpm to 800 rpm, and, when the device is in operation, liquid is supplied to the nozzles at a pressure in the range of 50 bar to 450 bar.

It is also provided a cleaning apparatus, characterized by a plurality of cleaning devices according to the invention, each cleaning device being connected to a central unit comprising at least one liquid intake opening and a liquid return opening; each liquid intake opening being fluidly connected to a respective liquid discharge opening; and the liquid return opening being fluidly connected to a liquid reservoir. The cleaning devices are preferably connected via hinge means to respective side faces of the central unit, and the central unit further comprises a pump means which is fluidly connected to the at least one liquid intake openings and to the liquid return opening.

Each of the cleaning devices preferably comprises rotatable support means arranged and configured for supporting each of the cleaning devices a distance from the surface to be cleaned, In one embodiment, the distance is approximately 12 millimetres.

As also specified in the attached claims it is also provided an underwater vehicle, having a roll axis (x), a pitch axis (y), and a yaw axis (z), all of said axes intersecting the vehicle's centre of gravity; the vehicle comprising propulsion means and buoyancy means, characterized by at least one pair of trimming means, where the elements of each pair are arranged on opposite sides of the centre of gravity; each said trimming means comprising a movable mass and a displacement region into which the mass can move, whereby the trimming means' individual centre of gravity is automatically shifted when the vehicle is accelerating or changes its orientation in the water.

In one embodiment, the trimming means of the first pair are arranged in a plane which is parallel with the vehicle's y-z plane, and a distance away from the centre of gravity; and the trimming means of the second pair are arranged in the x-y plane and along the x axis.

In one embodiment, first buoyancy means are arranged on a first external side of the vehicle and second buoyancy means are arranged on a second external side of the vehicle, on the opposite side of side first side.

In one embodiment, each of the trimming means comprise closed and mutually isolated compartments, each such compartment being partly filled with a substance having a specific gravity greater than one. The substance may comprise a liquid, such as mercury, or a powder.

In a preferred embodiment, each trimming means comprise a sealed and isolated compartment. In one embodiment, the first trimming means comprise tubular elements, each element extending substantially the width of the vehicle.

In one embodiment, each first trimming means comprises two slanted regions interconnected by a level central region. In one embodiment, the displacement region is in the slanted region.

The first trimming means are in one embodiment arranged in region of the second buoyancy means, and the second trimming means are arranged on opposite sides of the centre of gravity and concentric with the x axis.

The underwater vehicle is preferably a neutrally buoyant ROV and is configured for carrying and operating at least one cleaning device according to the invention, or a cleaning apparatus according to the invention.

The skilled person will understand that movable weights constitute an equivalent variant of the trim tanks described above. That each, the liquid or powder filled trim tanks may be replaced by astable and movable trim weights that are configured to move a predetermined distance.

BRIEF DESCRIPTION OF THE DRAWINGS

These and other characteristics of the invention will be clear from the following description of a preferential form of embodiment, given as a non-restrictive example, with reference to the attached drawings wherein.

DETAILED DESCRIPTION OF A PREFERENTIAL EMBODIMENT

Figure 1:
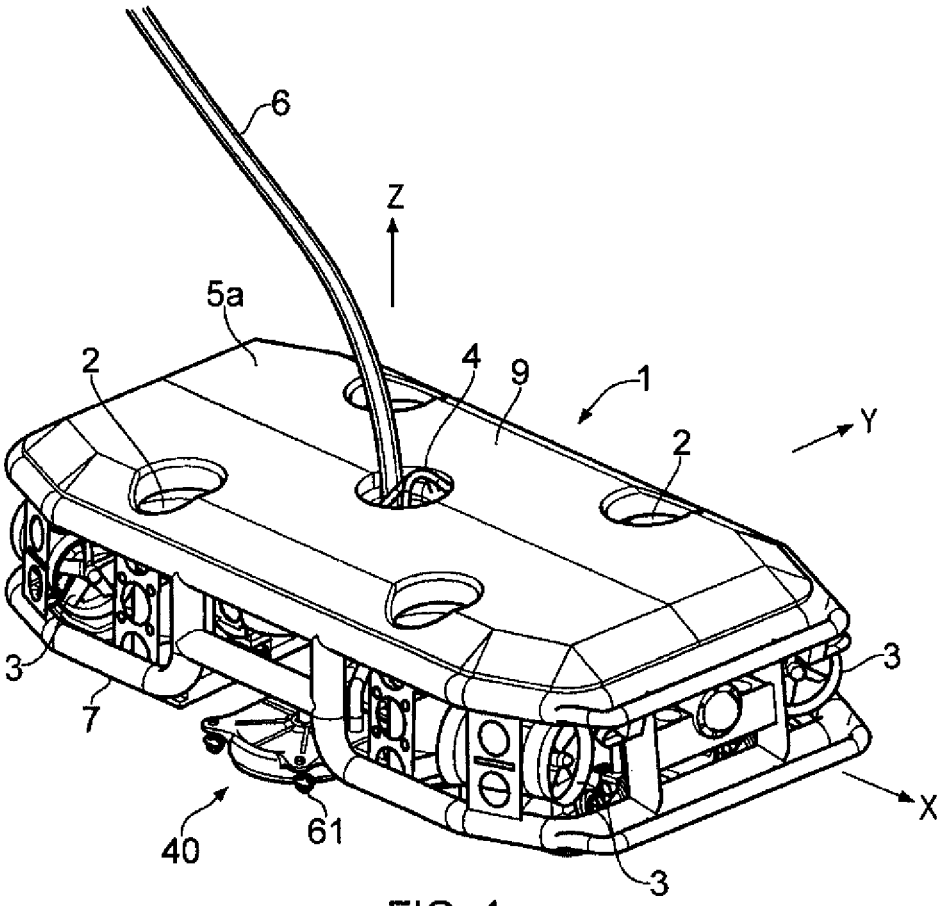
FIG. 1 is a perspective view of an embodiment of the cleaning robot according to the invention.
Figure 2:
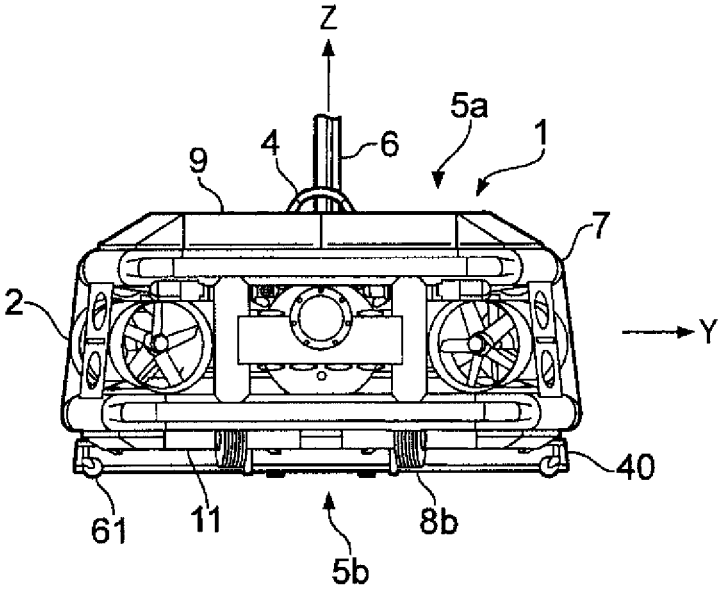
FIG. 2 is a front view of the cleaning robot illustrated in FIG. 1.

Referring initially to FIG. 1 and FIG. 2, the cleaning robot 1 in the illustrated embodiment basically comprises a tubular frame 7 carrying a cleaning apparatus 40. The cleaning robot 1 is a neutrally buoyant ROV being remotely controlled by an umbilical 6. The umbilical 6 holds power cables and control cables and extend to power and control units (not shown), located for example on a ship or barge on the water surface. The umbilical 6 also holds power and control cables, as well as liquid supply and return hoses, for operation of the cleaning apparatus 40.

Figure 20:
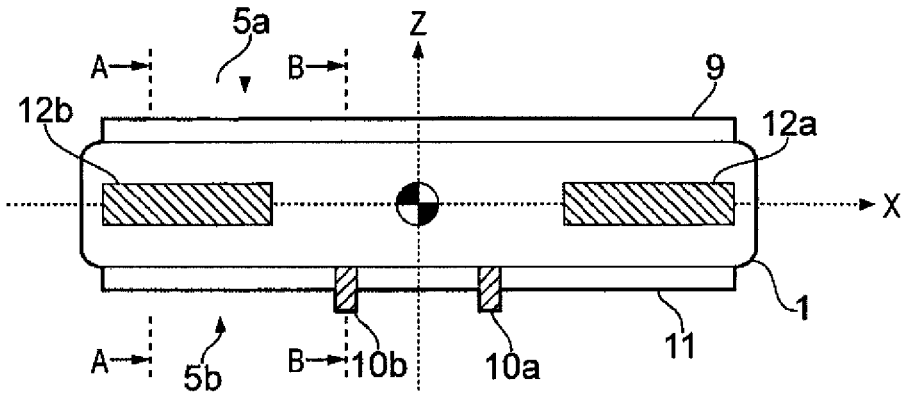
FIG. 20 is a schematic sketch of the cleaning robot, in the x-z plane.
Figure 21:
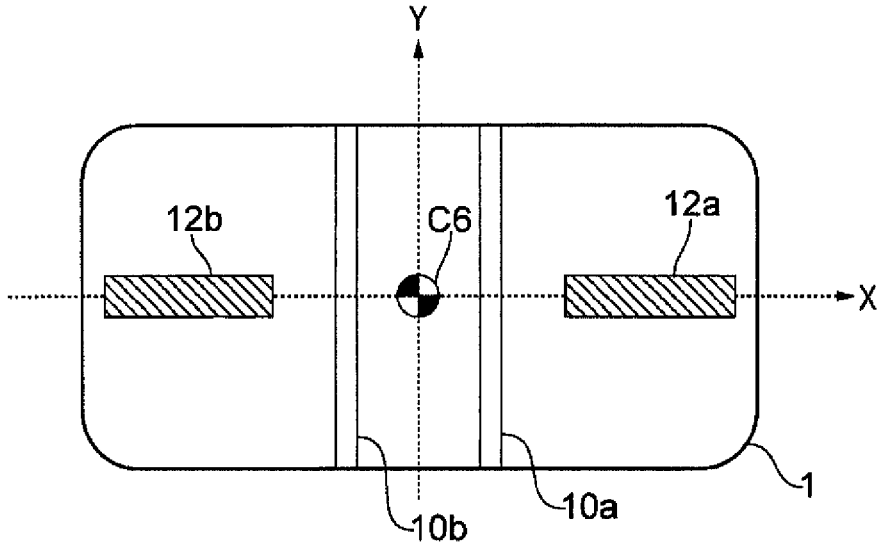
FIG. 21 is a schematic sketch of the cleaning robot, in the x-y plane.
Figure 22:
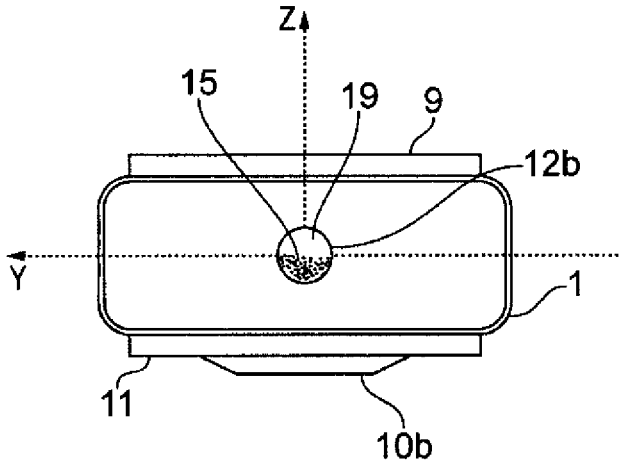
FIG. 22 is an end view, taken at the section line A-A in FIG. 20.
Figure 23:
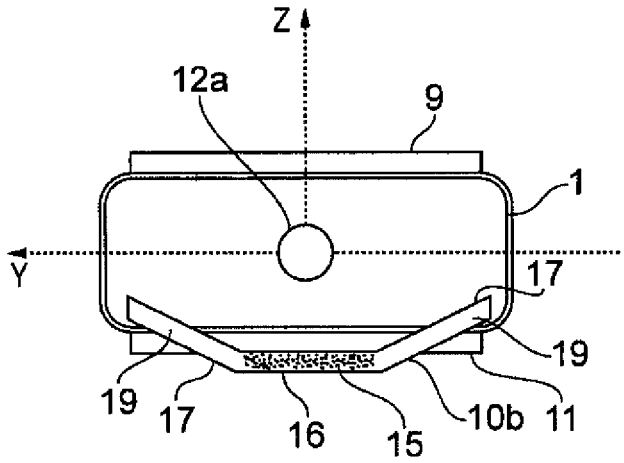
FIG. 23 is an end view, taken at the section line B-B in FIG. 20.

A coordinate system has been defined for the ROV 1, the axes of which intersect the ROV's centre of gravity (CG; see also FIGS. 20 and 21), and where the x axis defines a roll axis; the y axis defines a pitch axis; and the z axis defined a yaw axis. When floating in the water in the state shown in FIGS. 1 and 2, the z axis points upwards and the ROV has an upper side 5*a*, to which the umbilical 6 and a lifting padeye 4 are attached, and a lower side 5*b* where wheels 8*a,b* (shown also in FIGS. 3 and 4) are attached. The terms "upper" and "lower" are relative terms, as the ROV may assume any orientation in the water. In the following, therefore, the upper side in FIG. 1 is denoted the first side 5*a*, and the lower side in FIG. 1 is denoted the second side 5*b*.

The ROV 1 is furnished with thrusters 2, 3, which is used to control the ROV in the water, in a manner which is well known to the skilled person. These thrusters are electrically powered in the illustrated embodiment, but may also be hydraulically powered, but in a manner and with equipment which are well known in the art. The operation of an ROV per se is well known and will therefore not be discussed further.

Figure 3:
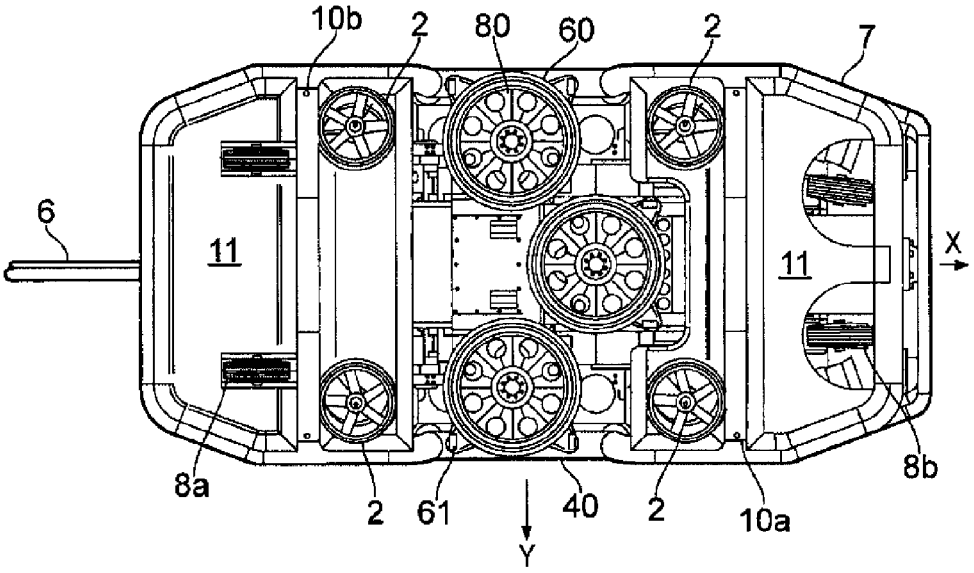
FIG. 3 is a plan view of the cleaning robot illustrated in FIG. 1; seen from below.
Figure 4:
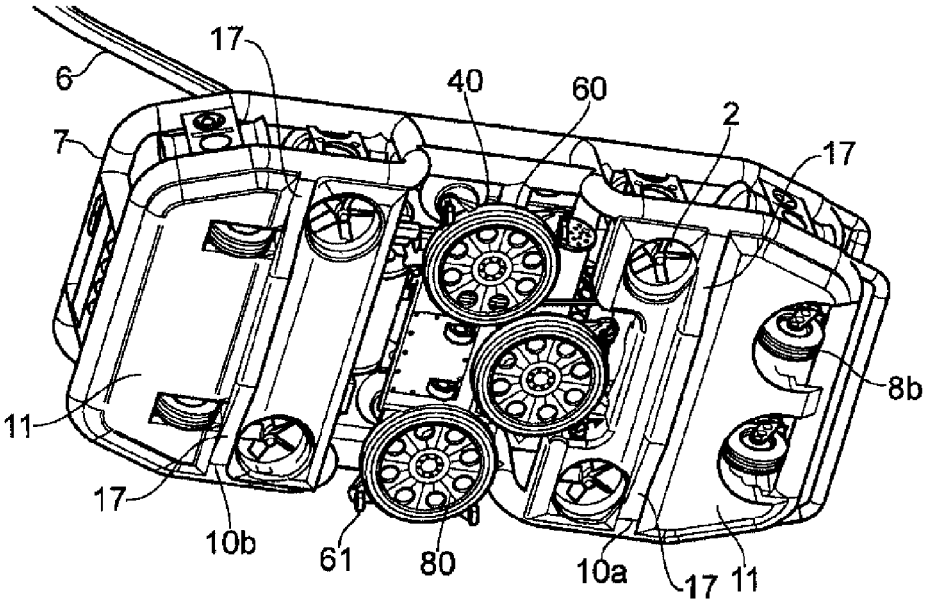
FIG. 4 is another perspective view of the cleaning robot.
Figure 5:
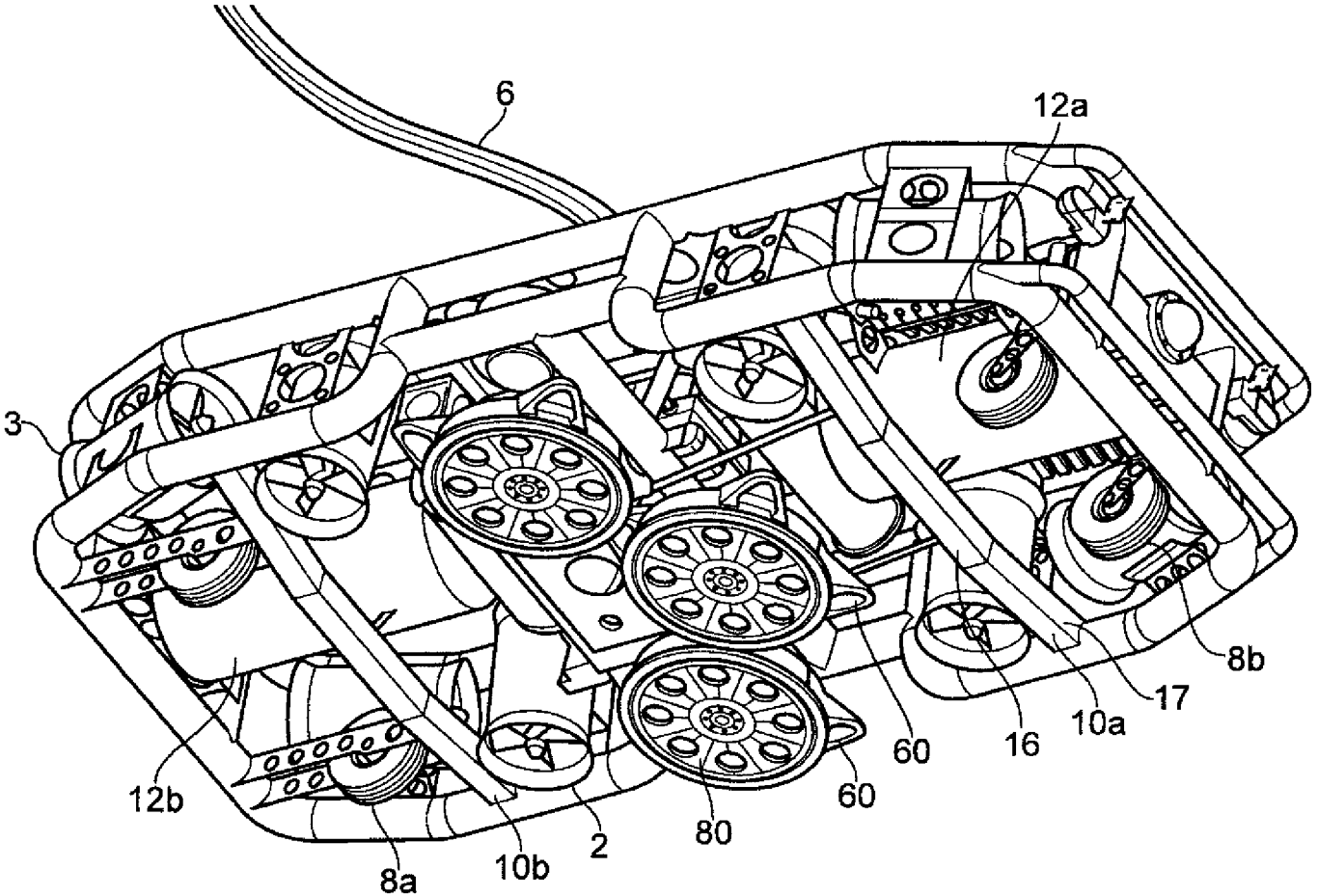
FIG. 5 is a perspective view of the cleaning robot according to the invention, with certain components removed to illustrate internal components of the robot.
Figure 6:
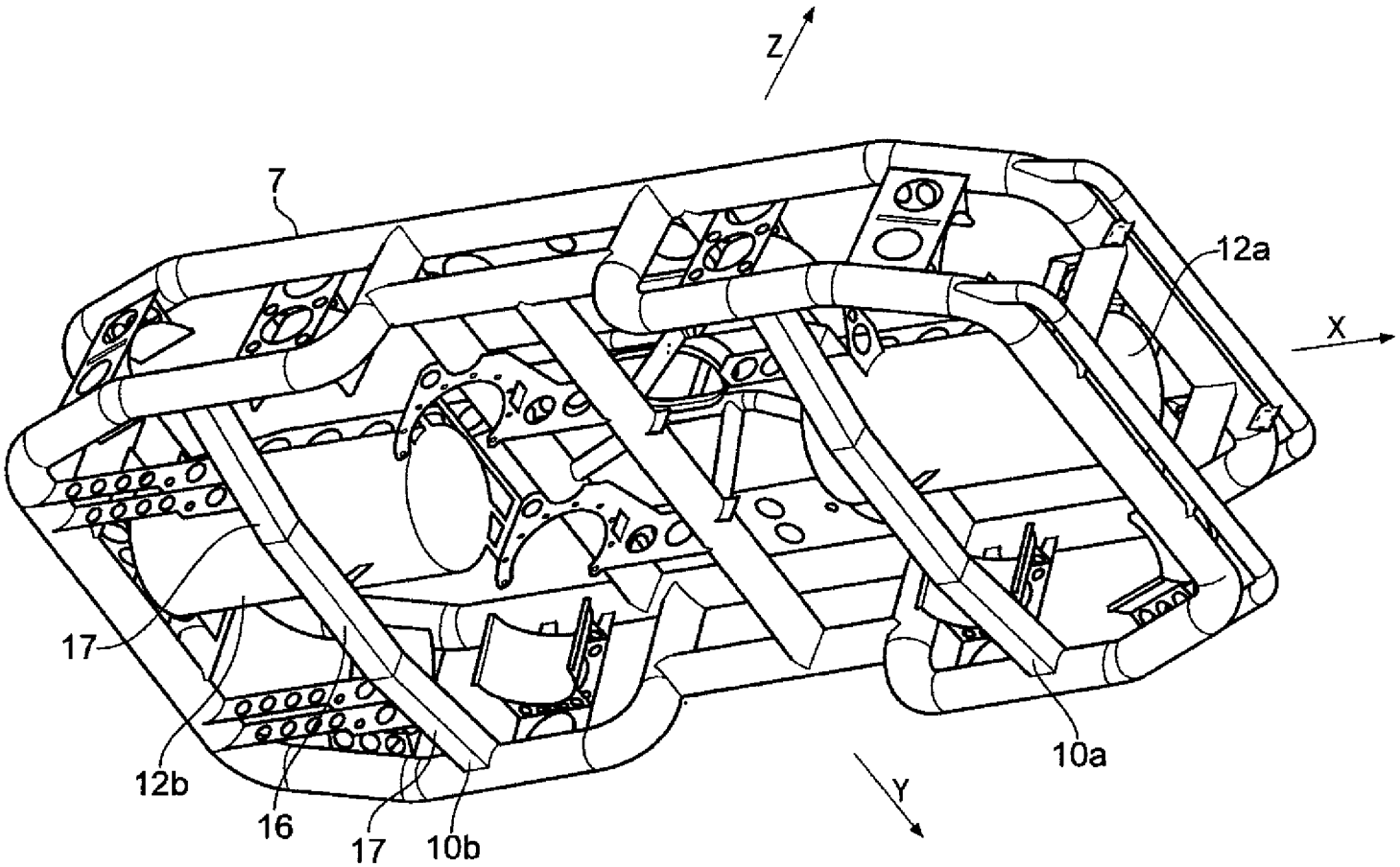
FIG. 6 is a perspective view similar to that in FIG. 5, but with yet further components removed.

Referring now additionally to FIGS. 3 and 4, wheels 8*a*, 8*b* are attached to the ROV's second side 5*b*. The front wheels 8*b* are a pair of caster wheels. In operation, when the ROV is used for cleaning a submerged surface, such as the submerged portion of a ship's hull, the ROV is rolling along the hull on the wheels 8*a*, 8*b*, and being pressed against the hull side by the thrusters 2. Movement along the hull is provided by one or more of the thrusters 3. The wheels thus provide an undercarriage and a rolling support for the ROV against the ship's hull. The cleaning apparatus 40, which in the illustrated embodiment comprises three cleaning devices 60, also comprise wheels 61 for supporting the cleaning apparatus 60 at a predetermined distance from the ship's hull.

Referring now additionally to FIGS. 5, 6, 20, 21, 22 and 23, buoyancy elements in the form of panels are attached to both sides of the ROV. An upper (or first) buoyancy element 9 is attached to the first side 5*a* and a lower (or second) buoyancy element 11 is attached to the second side 5*b*. The ROV is thus neutrally buoyant in water, and only a small force from the vertical thrusters 2 (and/or the lateral thrusters 3) will be required to move the ROV up or down.

The first buoyancy element 9 provides more buoyancy than the second buoyancy element 11, such that the centre of buoyancy (CB) is located above the CG when the ROV has the attitude as shown in FIGS. 1 and 2. As the skilled person will know, small ROVs are easily perturbed due to underwater currents. Therefore, in order to improve the control of the ROV in its neutral-buoyancy state, and to improve ROV's stability in the range of orientations it may have (when cleaning the vertical, or near vertical, hull) and thus enhance the cleaning operation, the ROV comprises pairs of trim tanks 10*a,b*, 12*a,b*, which will be described in the following.

A pair of first, transverse, trim tanks 10*a,b* are arranged in a plane which is parallel with the ROV's y-z plane and a distance away from the CG, and a pair of second trim tanks 12*a,b* are arranged in the x-y plane and on the x axis.

In the illustrated embodiment, the pair of first trim tanks 10*a,b* are made of tubular profiles, each one extending substantially the width of the ROV, and are arranged in on the ROV's second side, near the second buoyancy elements 11. Each first trim tank comprises a generally level central portion 16 (generally parallel with the x-y plane) and inclined portions 17 on both sides of the central portion This position of the trim tanks 10*a,b* provides a moment arm which enhances ROV manoeuvrability. The pair of second trim tanks 12*a,b* are arranged on opposite sides of the centre of gravity, and concentric with the x axis.

Each trim tank 10*a,b*, 12*a,b* are closed compartments, sealed and isolated from each other. Each trim tank is partly filled (preferably 5% to 15% of tank volume) with a substance 15, such as a liquid or a powder (see FIGS. 22, 23), having a specific gravity greater than 1. One suitable substance is liquid mercury. It can be seen from FIGS. 22 and 23 that the substance 15 has available volume in which to be displaced when the ROV is subjected to a perturbation.

As mentioned above, the upper buoyancy element 9 provides more buoyancy than the lower element 11. When the ROV is floating horizontally in the water (e.g. as in FIG. 1), the trim substance is at rest and the ROV is stable in the water. When the ROV is accelerating in a plane or changes its attitude, the trim substance in each trim tank will be displaced due to gravity and inertia, and always keep the CG of the ROV below its CB. The trim substances are separate, movable masses, that each is astable with respect to the ROV frame. Due to the action of the astable trim substances, therefore, the ROV will always be stable, irrespective of the orientation of the ROV in the water. That is, the ROV's CB will always be above the ROV's CG, irrespective of the ROV's orientation and attitude.

The partly filled trim tanks 10*a,b*, 12*a,b* thus constitute autonomous trimming apparatuses in that the trim tanks' individual centre of gravity is automatically shifted when the ROV is accelerating or changes its orientation in the water.

The cleaning apparatus 40 will now be described in more detail, with reference to FIGS. 7-19.

Figure 7:
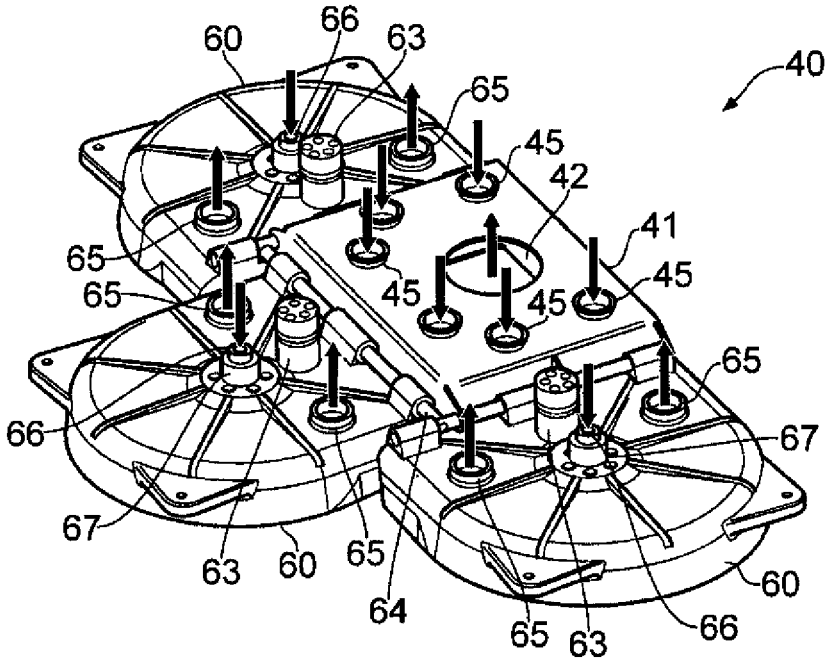
FIG. 7 is a perspective view of an embodiment of the cleaning apparatus according to the invention.

As illustrated by FIG. 7, the cleaning apparatus 40 comprises in the illustrated embodiment three identical cleaning units 60, each furnished with supports for wheels 61 (see e.g. FIG. 4) and connected via a respective hinge 64 to a central housing 41. The housing is connected the ROV by fastening means (not shown).

Figure 8:
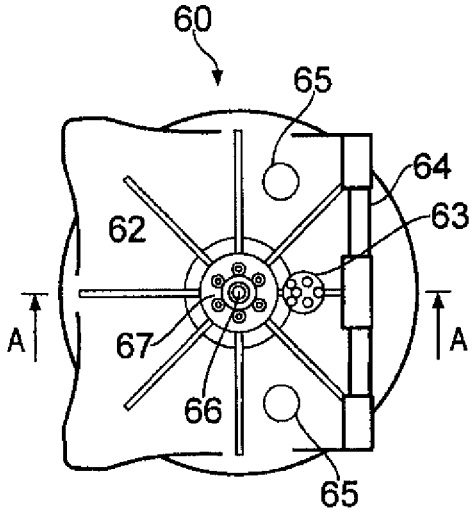
FIGS. 8 and 9 are plan views of a cleaning device, seen from opposite sides.
Figure 9:
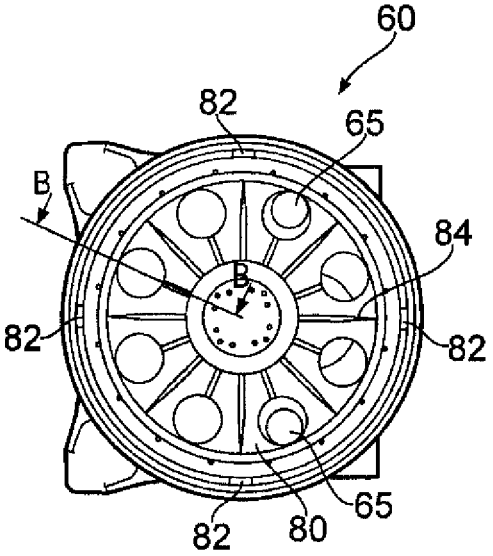
Figure 10:
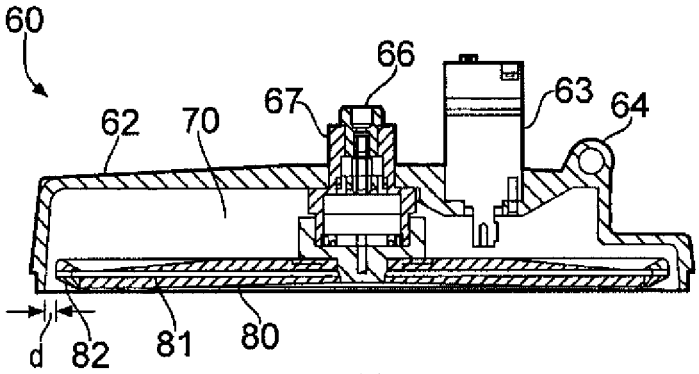
FIG. 10 is a section drawing along the section line A-A in FIG. 8.
Figure 11:
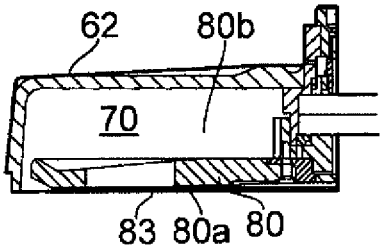
FIG. 11 is a section drawing along the section line B-B in FIG. 9.
Figure 12:
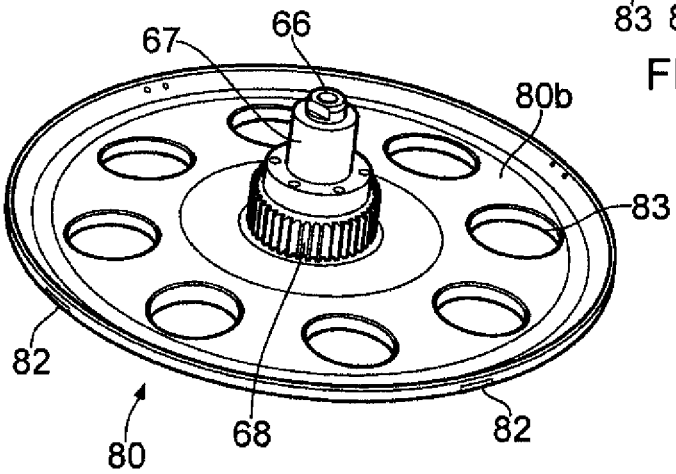
FIGS. 12 and 13 are perspective views of an embodiment of the cleaning disk according to the invention.
Figure 13:
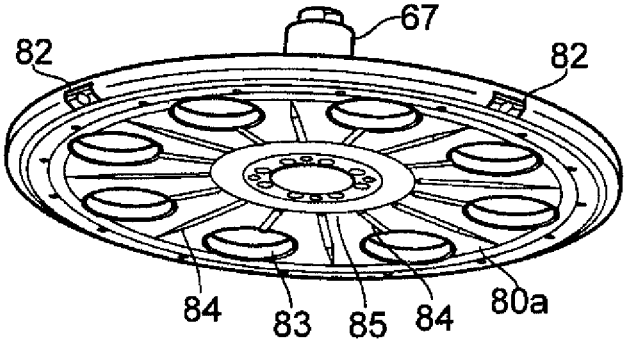
Figures 14, 15, 16:
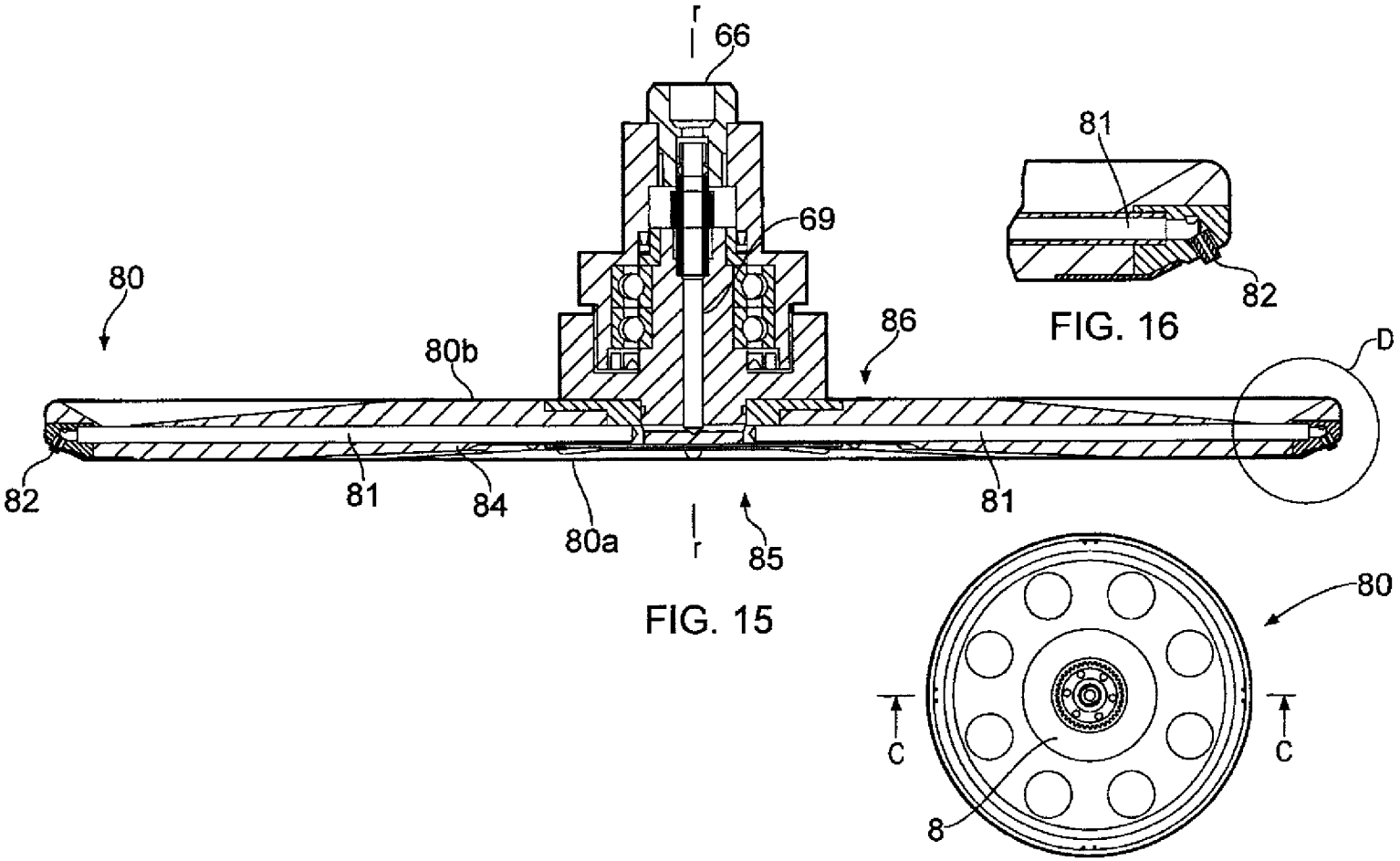
FIG. 14 is a plan view of the cleaning disk illustrated in FIGS. 12 and 13.
FIG. 15 is a section drawing along the section line C-C in FIG. 14.
FIG. 16 is an enlarged view of the region marked "D" in FIG. 15.

Referring additionally to FIGS. 8 and 9, each cleaning unit 60 comprises a cleaning disk 80 arranged in a housing 62 and rotatably supported in the housing by a spindle 67. The cleaning disk 80 is rotated about it axis of rotation (r) by a drive motor 63, which may be electrically or hydraulically powered, in a manner which per se is known in the art. The spindle 67 comprises a bore 66, through which cleaning fluid is fed into the cleaning disk (described further below).

Each cleaning unit 60 also comprises outflow openings 65 through which liquid is expelled from inside the housing 62 when the unit is in operation. Each outflow opening 65 is fluidly connected to a corresponding inflow opening 45 on the central housing 41, preferably via flexible hoses (not shown). The wide arrows in FIG. 7 indicate liquid flow direction when the unit is in operation.

The central housing 41 holds a motor and a pump (not shown), by means of which liquid is extracted from the outflow openings 65, into the inflow opening 45 and returned to a reservoir (not shown) via a hose (not shown) connected to the return flow opening 42. The return hose is bundled together with control cables and power cables in the umbilical 6 (cf. FIG. 1)

Referring additionally to FIGS. 10-14, the cleaning disk 80 is arranged in the housing 62, thus forming a cavity 70. The distance d between the disk perimeter and the housing wall is determined such that the liquid leakage between the cavity 70 and the ambient water is as low as possible; a typical value being 12 mm.

The cleaning disk comprises a gear wheel 68 for connection to the above mentioned motor 63. The cleaning disk also comprises a number of nozzles 82 (in the illustrated embodiment: four) arranged at regular intervals around the disk periphery. Each nozzle 82 is connected to the bore 66 via a respective channel 80, in a manner which per se in known in the art. Cleaning fluid is thus supplied under pressure from an external source (not shown), via the bore and channels, and ejected through each nozzle. The nozzles 82 are arranged such that the cleaning liquid is ejected more or less radially from the disk, and inclined downwardly (see e.g. FIG. 10), out from the housing 62 such that the cleaning liquid will impinge the adjacent hull surface which is being cleaned. The pressure with which the cleaning liquid is supplied to the nozzles is dimensioned to suit the properties of the surface which is to be cleaned. For example, a pressure of 50 bar is suitable for silicone anti-fouling, while a pressure of 450 bar is suitable for hard-coating.

The cleaning disk 80 furthermore comprises a number of openings, or holes, 83, extending between the disk's inner side 80*b* and its outer side 80*a* (the outer side 80*a* being the side facing the hull when the unit is in operation). The holes 83 are arranged at regular intervals around the disk. The number and size of the holes are determined in relation to the disk diameter, depending on the intended use. When the disk is rotating, the holes serve as liquid transfer ports, transporting liquid from the disk's outer side to the inner side and into the cavity 70, from which it is evacuated through the outflow openings 65, as described above.

The holes also counteract the capillary forces occurring when the disk is rotating (creating suction between the disk and the ship's hull), thus allowing a higher rotational speed than what would the possible with a solid disk. The invented disk may operate at speeds around 600-700 rpm without developing noticeable suction forces.

A region of the cleaning disk's outer side 80*a*—where it is not perforated by the holes 83—comprises a concave region 85. This concavity mitigates to a certain extent the suction that develops in the central region of the disk.

The cleaning disk's outer side 80*a* also comprises a number of ridges 84 that extend radially from the disk's central region towards its periphery. Every other ridge extends between adjacent holes, and every other ridge extends to a hole. The ridges are tapered, with a height gradually reducing towards the disk periphery. The ridges function as blades, or vanes, imparting a swirling motion to the liquid. This improves the cleaning action.

Figure 17:
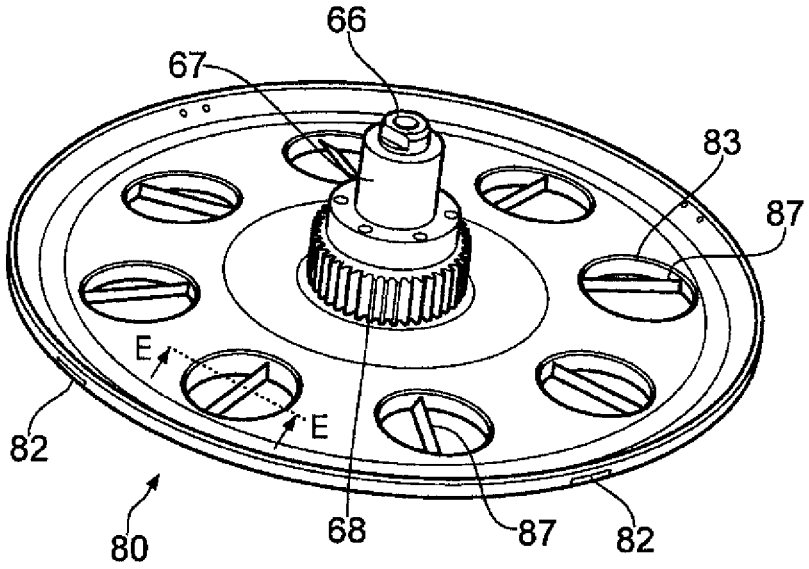
FIG. 17 is a perspective drawing of another embodiment of the cleaning disk according to the invention.
Figure 18:
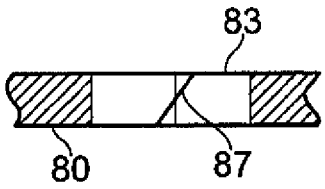
FIG. 18 is a section drawing along the section line E-E in FIG. 17.
Figure 19:
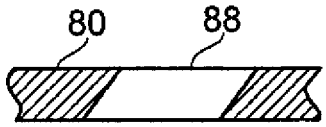
FIG. 19 is a section drawing showing another embodiment of the disk hole.

Referring FIG. 17, the holes 83 may be furnished with vanes 87, arranged radially with respect to the disk 80. The vanes 87 may be aligned with the disk rotational axis of set at an angle (indicated by dotted and solid lines, respectively, in FIG. 18), to further improve the liquid transfer through the holes. FIG. 19 shows yet another embodiment of the holes, having slant walls.

The following is a numerical example, for one cleaning unit with one disk:

| | |
|---|---|
| Disk diameter (mm) | 480 |
| Concavity (mm) | 8 |
| Number of holes | 8 |
| Hole diameter (mm) | 70 |
| Rotational speed (rpm) | 600 |
| Number of nozzles | 4 |
| Cleaning liquid feed pressure (bar) | 350/450 |
| Cleaning liquid flow rate (liters/minute) | 135/80 |

Although the invention has been described above in relation to a ship's hull, it should be understood that the invention is equally applicable for operation on any submerged surface, such as any floating vessel, and underwater walls or structures of any kind.

The invention claimed is:

1. A remotely operated underwater vehicle for carrying cleaning devices for cleaning of surfaces submerged in water, the underwater vehicle comprising a roll axis (x), a pitch axis (y), and a yaw axis (z), wherein all of the axes intersect a center of gravity of the underwater vehicle, the vehicle comprising:

a first side, a second side, a thruster, a plurality of trim tanks, a first buoyancy element attached to the first side in a plane parallel to an x-y plane of the vehicle and above the center of gravity, and a second buoyancy element attached to the second side in a plane parallel to an x-y plane of the vehicle and below the center of gravity, wherein at least two of the plurality of trim tanks are arranged on opposite sides of the center of gravity of the vehicle and at least one of the plurality of trim tanks comprises a movable mass and a displacement region into which the movable mass can move, whereby the center of gravity of the vehicle is automatically shifted due to gravity and inertia when the vehicle is accelerating or changes orientation in the water, wherein the first buoyancy element provides more buoyancy than the second buoyancy element, and wherein the center of buoyancy of the vehicle is located above the center of gravity of the vehicle irrespective of the orientation and attitude of the vehicle.

2. The underwater vehicle of claim 1, wherein a first pair of the plurality of trim tanks is arranged in a plane parallel to a y-z plane of the vehicle and a distance away from the center of gravity of the vehicle, and wherein a second pair of the plurality of trim tanks is arranged in an x-y plane of the vehicle and along an x axis.

3. The underwater vehicle of claim 2, wherein the first pair of the plurality of trim tanks comprises a plurality of tubular elements, each of the plurality of tubular elements extends substantially along a width of the vehicle.

4. The underwater vehicle of claim 3, wherein each of the first pair of the plurality of trim tanks comprises slanted regions interconnected by a level central region.

5. The underwater vehicle of claim 4, wherein the displacement region is located within the slanted regions.

6. The underwater vehicle of claim 2, wherein the first pair of the plurality of trim tanks is arranged in a region of the second buoyancy element.

7. The underwater vehicle of claim 2, wherein each of the trim tanks of the second pair of the plurality of trim tanks are arranged opposite each other with respect to the center of gravity of the vehicle and concentric with the x axis.

8. The underwater vehicle of claim 1, wherein the first buoyancy element is arranged on the first side of the vehicle and the second buoyancy element is arranged on the second side of the vehicle opposite the first side.

9. The underwater vehicle of claim 1, wherein each of the plurality of trim tanks comprises a closed and mutually isolated compartment, wherein each compartment is configured to be contain a substance having a specific gravity greater than 1.

10. The underwater vehicle of claim 9, wherein the substance comprises a liquid.

11. The underwater vehicle of claim 10, wherein the liquid is mercury.

12. The underwater vehicle of claim 9, wherein the substance comprises a powder.

13. The underwater vehicle of any claim 1, wherein the vehicle is a neutrally buoyant remotely operated vehicle (ROV).

14. The underwater vehicle claim 1, wherein the first buoyancy element and the second buoyancy element are configured to allow for neutral buoyancy of the vehicle in water during operation.

15. The underwater vehicle of claim 1 further comprising a cleaning device for cleaning a surface submerged in water, the cleaning device comprising:

a disk member rotatably supported by a spindle and configured to rotate about a rotational axis (r) by a drive motor the disk member having a first side which is facing the surface when the device is in use, and a second side facing away from the surface, wherein the disk member further comprises:

a plurality of nozzles for discharging liquid under pressure against the surface, the plurality of nozzles being fluidly connected to a liquid reservoir via a first conduit in the disk member and a second conduit in the spindle; and a plurality of through holes spaced at regular intervals and arranged symmetrically with respect to the rotational axis (r).

16. The underwater vehicle of claim 15 further comprising:

a cleaning apparatus having a plurality of cleaning devices, each of the plurality of cleaning devices being connected to a central unit comprising a liquid intake opening and a liquid return opening, the liquid intake opening being fluidly connected to a respective liquid discharge opening and the liquid return opening being fluidly connected to the liquid reservoir.

* * * * *